US008657165B1

(12) United States Patent
Liu

(10) Patent No.: US 8,657,165 B1
(45) Date of Patent: Feb. 25, 2014

(54) SOCK WEARING FRAME

(71) Applicant: Metal Life Enterprises Co., Ltd., Changhua (TW)

(72) Inventor: Lu-Yang Liu, Changhua (TW)

(73) Assignee: Metal Life Enterprises Co., Ltd., Changhua (TW)

( * ) Notice: Subject to any disclaimer, the term of this patent is extended or adjusted under 35 U.S.C. 154(b) by 0 days.

(21) Appl. No.: 13/632,214

(22) Filed: Oct. 1, 2012

(51) Int. Cl.
*A47G 25/90* (2006.01)
*A47G 25/00* (2006.01)

(52) U.S. Cl.
USPC ..... 223/111

(58) Field of Classification Search
USPC ..... 223/111–119
See application file for complete search history.

(56) References Cited

U.S. PATENT DOCUMENTS

| | | | | | |
|---|---|---|---|---|---|
| 2,982,453 | A * | 5/1961 | Zicarelli | ..... | 223/112 |
| 3,231,160 | A * | 1/1966 | Glanville | ..... | 223/111 |
| 4,756,453 | A * | 7/1988 | Pettit et al. | ..... | 223/111 |
| 4,896,803 | A * | 1/1990 | Wilkens | ..... | 223/112 |
| 5,630,534 | A * | 5/1997 | Maier et al. | ..... | 223/112 |
| 8,083,110 | B2 * | 12/2011 | Wilkens | ..... | 223/111 |
| 2010/0147908 | A1 * | 6/2010 | Skerman | ..... | 223/111 |
| 2012/0061427 | A1 * | 3/2012 | Ruf | ..... | 223/112 |

* cited by examiner

*Primary Examiner* — Ismael Izaguirre

(57) ABSTRACT

The present invention provides a sock wearing frame, which comprises a base, wherein each of the two sides of the base is upwardly connected to two upright sticks, and the upper portions of the two upright sticks are horizontally installed with a lift stick. Also, the internal space surrounded by the upright sticks on the two sides of the sock wearing frame is installed with two supporting frames connected to the upright sticks and upwardly bended, a wearing ring is horizontally and backwardly installed over the supporting frame, and the front parts of the wearing ring along with the supporting frames on the two sides conjunctively constitute an opening.

2 Claims, 9 Drawing Sheets

SOCK WEARING FRAME

FIELD OF THE INVENTION

The present invention relates to a sock wearing frame; in particular, the present invention relates to a stock wearing frame enabling a sock wearing assistance feature.

BACKGROUND

For general people of normal physical functions, it is a plain and simple job to put socks on their feet; however, for the elderly suffering from e.g., vertebral wound or stiff joint illness, to successfully bend down and complete sock wearing actions without other people's help sometimes may become very difficult. Therefore, it would be highly desirable to resolve this issue by developing a new type of sock wearing frame structure to assist a patient in wearing socks.

With regards to this, the inventors of the present invention have devoted a great amount of efforts in considering and designing an innovative structure according to long-term professional knowledge as well as numerous researches and improvements to provide the present invention.

SUMMARY OF THE INVENTION

Technical features for resolving the aforementioned issues:

The present invention is to provide a sock wearing frame, in which the sock wearing frame can comprise a frame-wise base, and each of the two sides of the base is upwardly connected to two upright sticks. The two upright sticks are configured in parallel and demonstrate a mutually sleeve connected form with an external pipe and an internal pipe, thereby modifying the integral length of the upright sticks through upward and downward translations of the internal pipe in the sock wearing frame. Moreover, a lift stick is horizontally installed between the two internal pipes at the upper portions of the upright sticks. The internal space surrounded by the upright sticks on the two sides of the sock wearing frame is installed with two supporting frames connected to the upright sticks and upwardly bended. Besides, a wearing ring is horizontally and backwardly installed over the supporting frames, and the front parts of the wearing ring along with the supporting frames on the two sides conjunctively constitute an opening. In this fashion, a sock wearing frame according to the present invention is achieved.

ADVANTAGES IN COMPARISON WITH PRIOR ART

The sock wearing frame according to the present invention allows the elderly suffering from vertebral wound or stiff joint illness to successfully bend down and complete sock wearing actions without other people's help, thus assisting in keeping their regular work and rest activities so as to maintain convenience of self-organization in daily lives.

DETAILED DESCRIPTION OF THE PREFERRED EMBODIMENTS

To facilitate better appreciation of the objectives, characteristics and functions achieved and provided by the present invention, preferred embodiments according to the present invention are illustrated in conjunction with appended drawings, as described in details hereunder.

Figure 1:
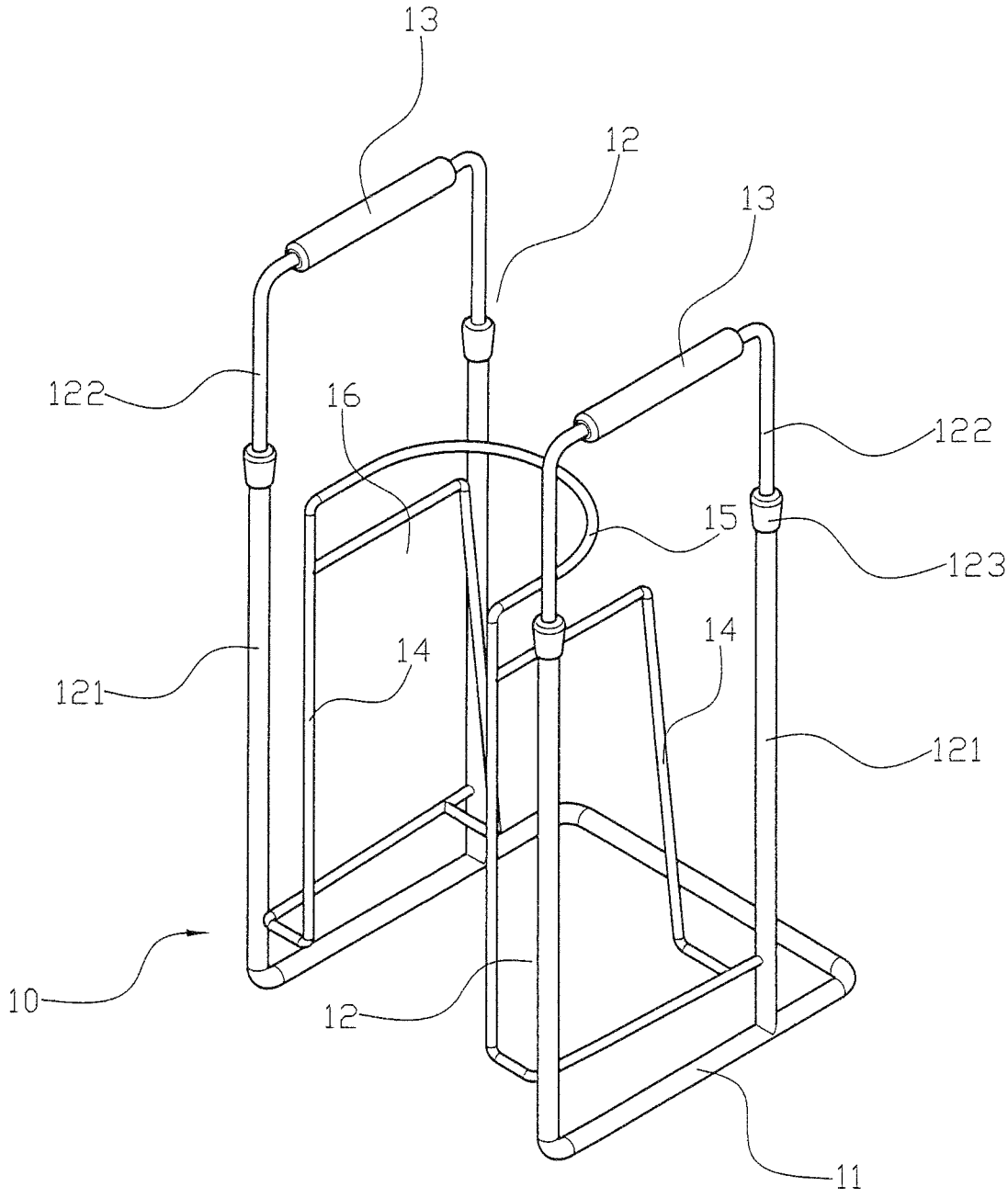
FIG. 1 shows a diagram of the present invention, wherein all parts of the stock wearing frame is assembled together.
Figure 2:
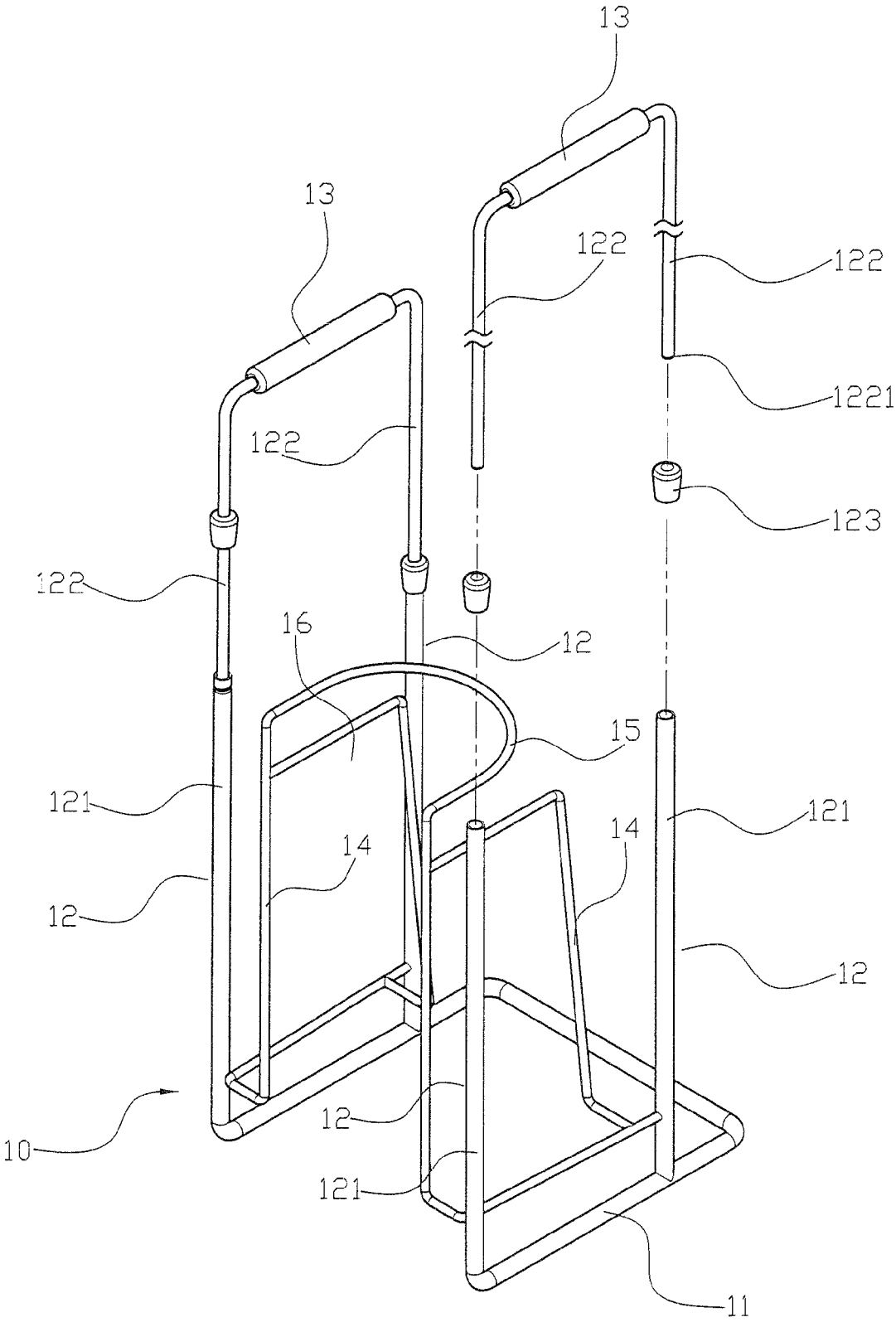
FIG. 2 shows a diagram of the present invention, wherein the expansion part of the invention is shown in exploded view.
Figure 3:
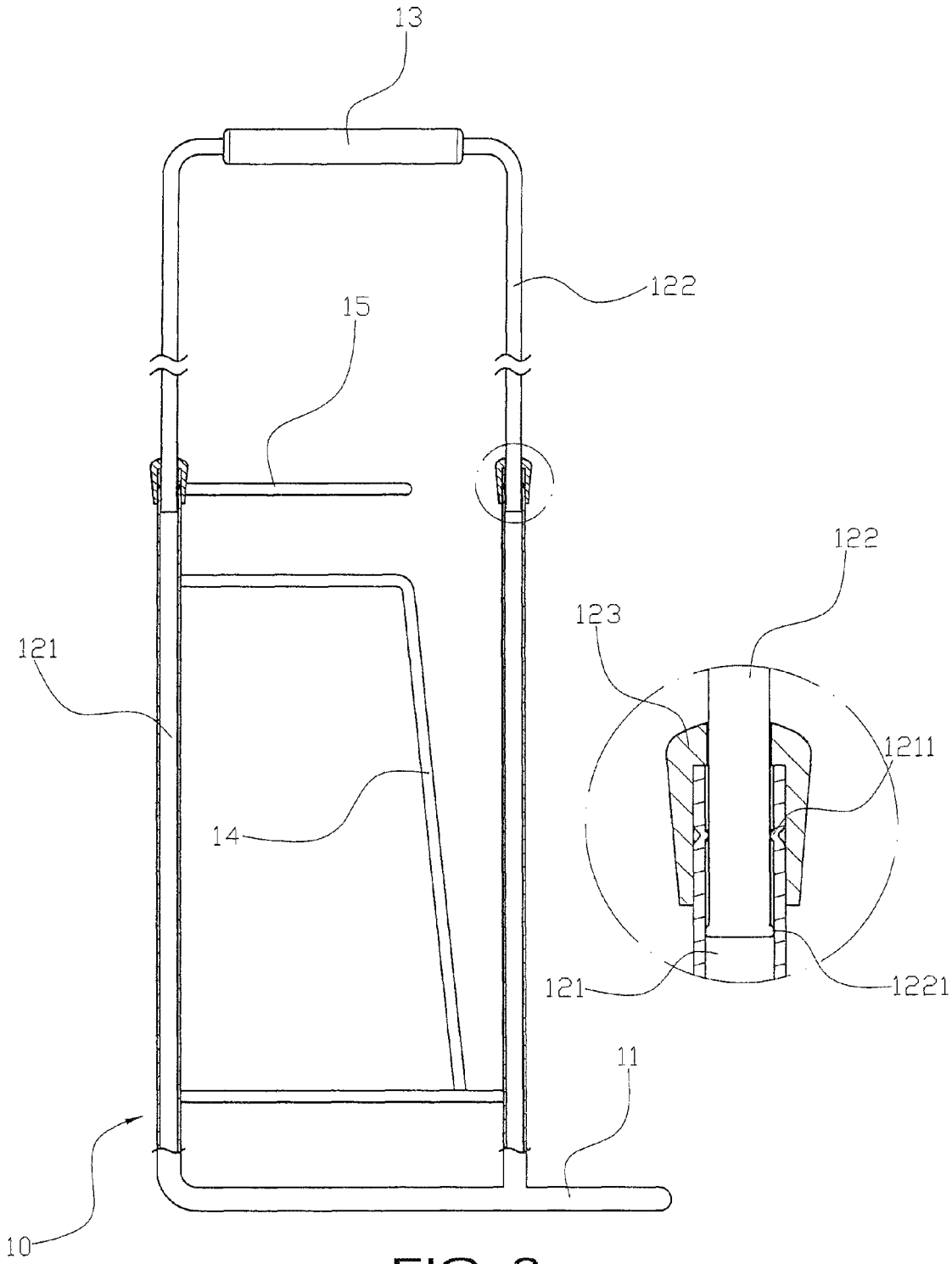
FIG. 3 shows a side view of the present invention and a detailed view of a part of the present invention.
Figure 4:
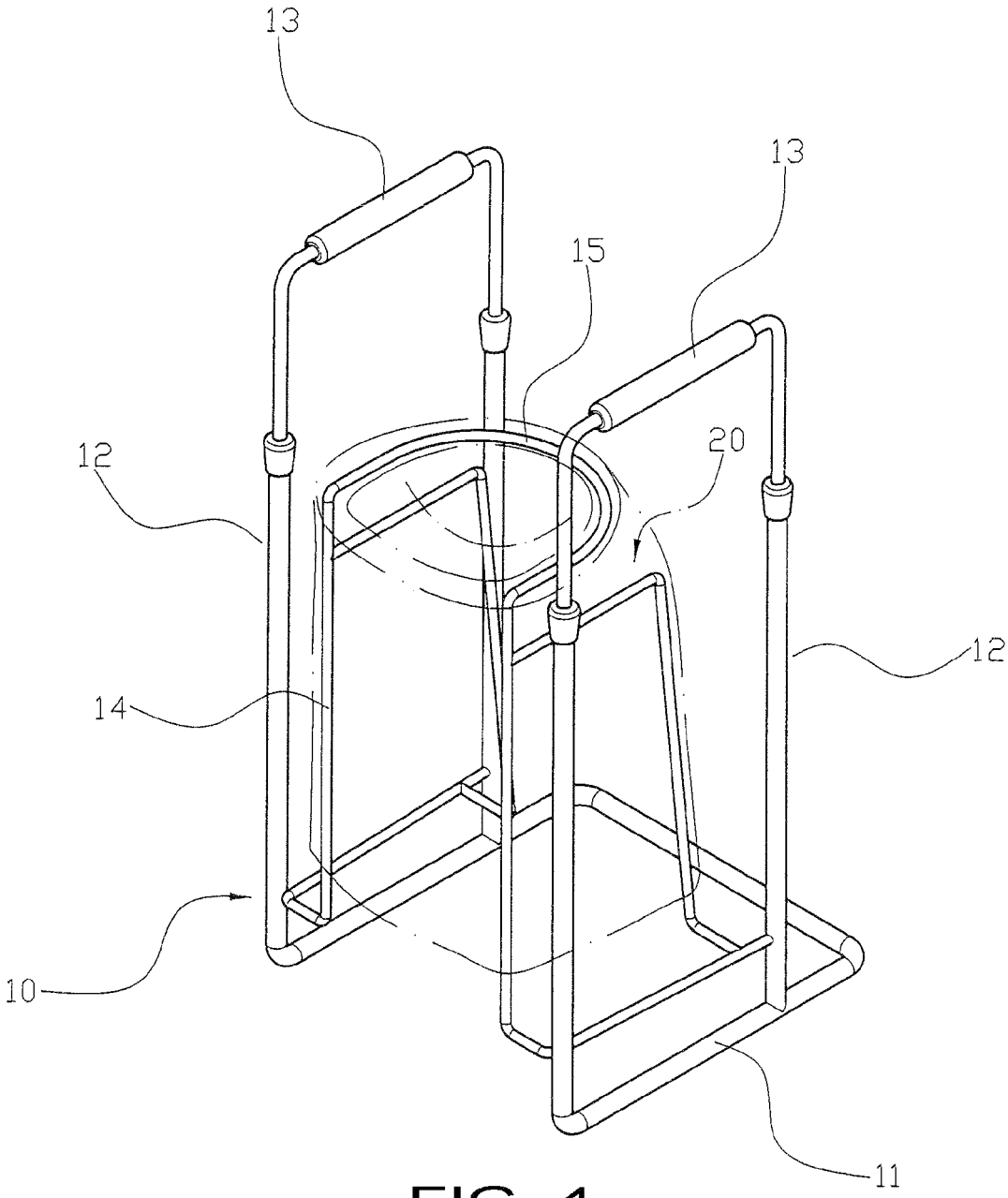
FIG. 4 shows a diagram the present invention, wherein a sock is disposed onto the wearing ring.
Figure 5:
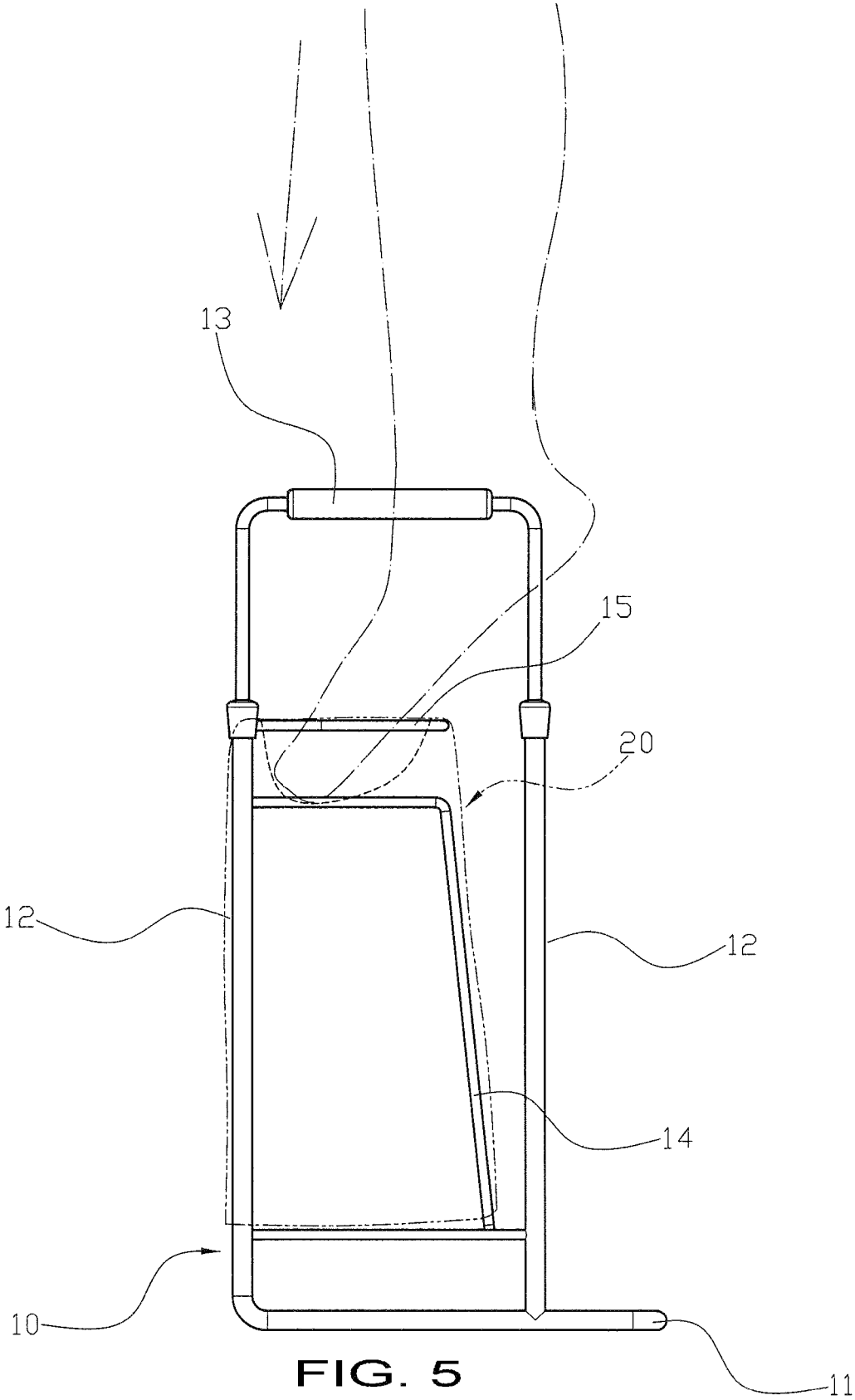
FIG. 5 shows an action diagram 1 in application of the present invention.
Figure 6:
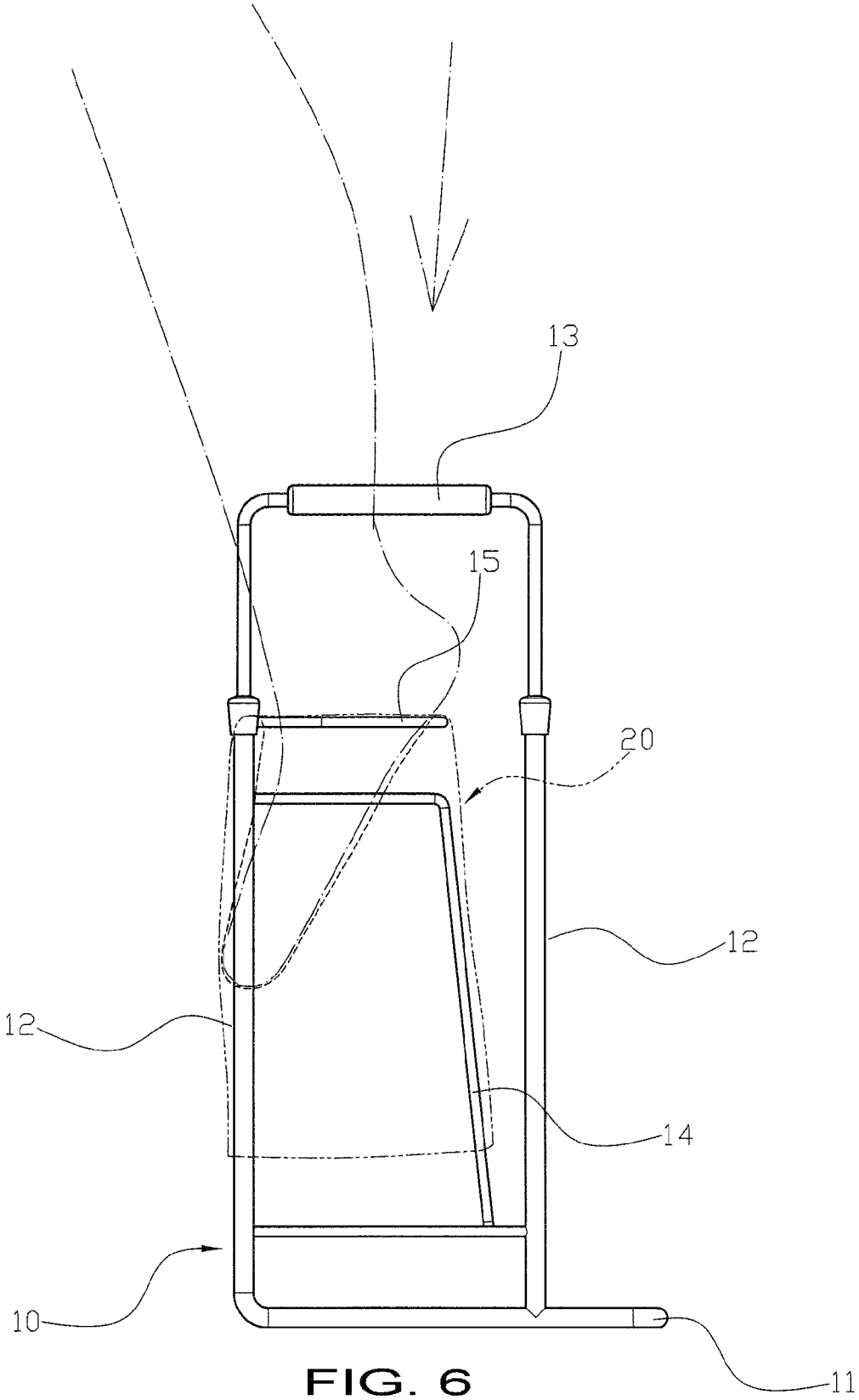
FIG. 6 shows an action diagram 2 in application of the present invention.
Figure 7:
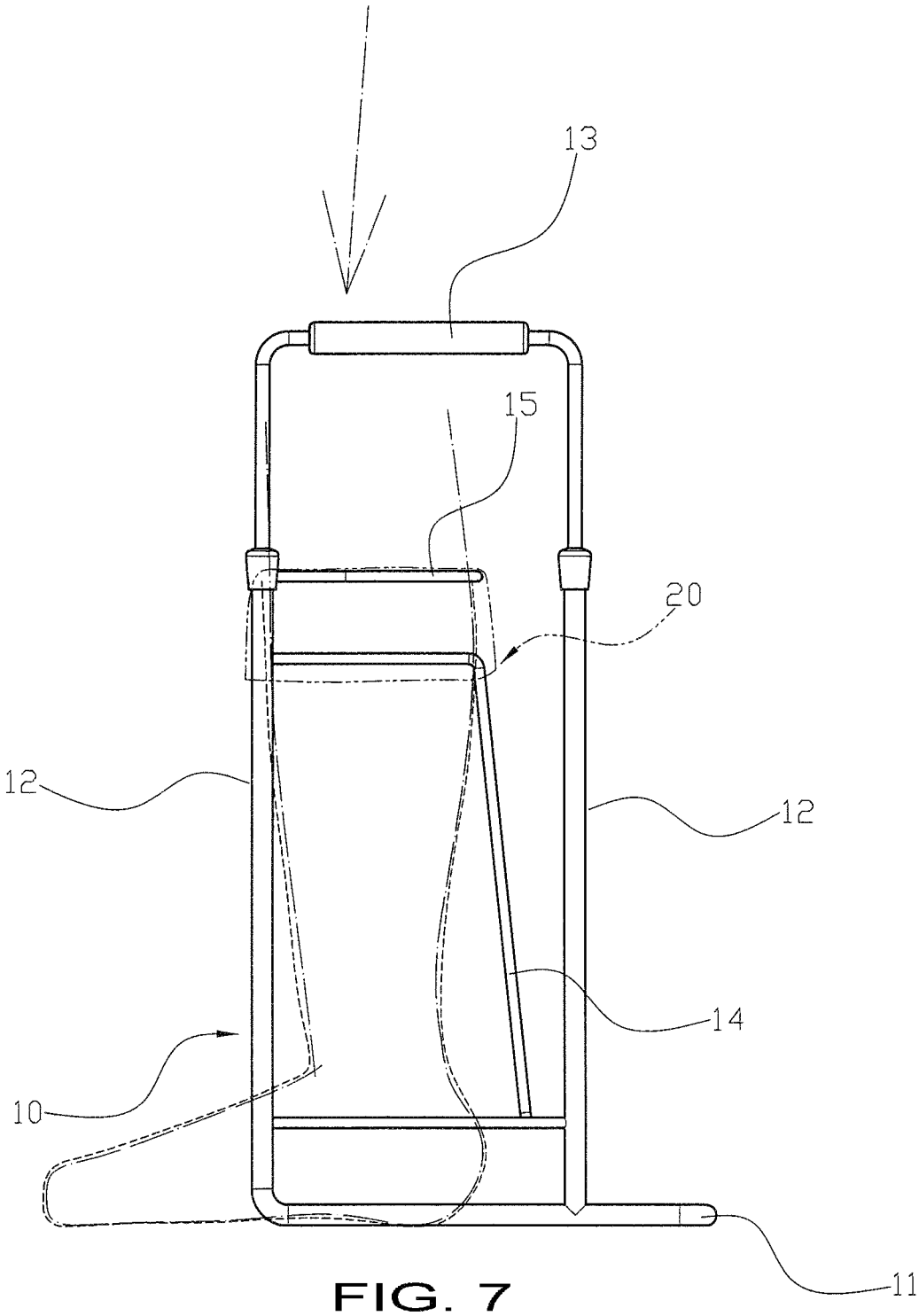
FIG. 7 shows an action diagram 3 in application of the present invention.
Figure 8:
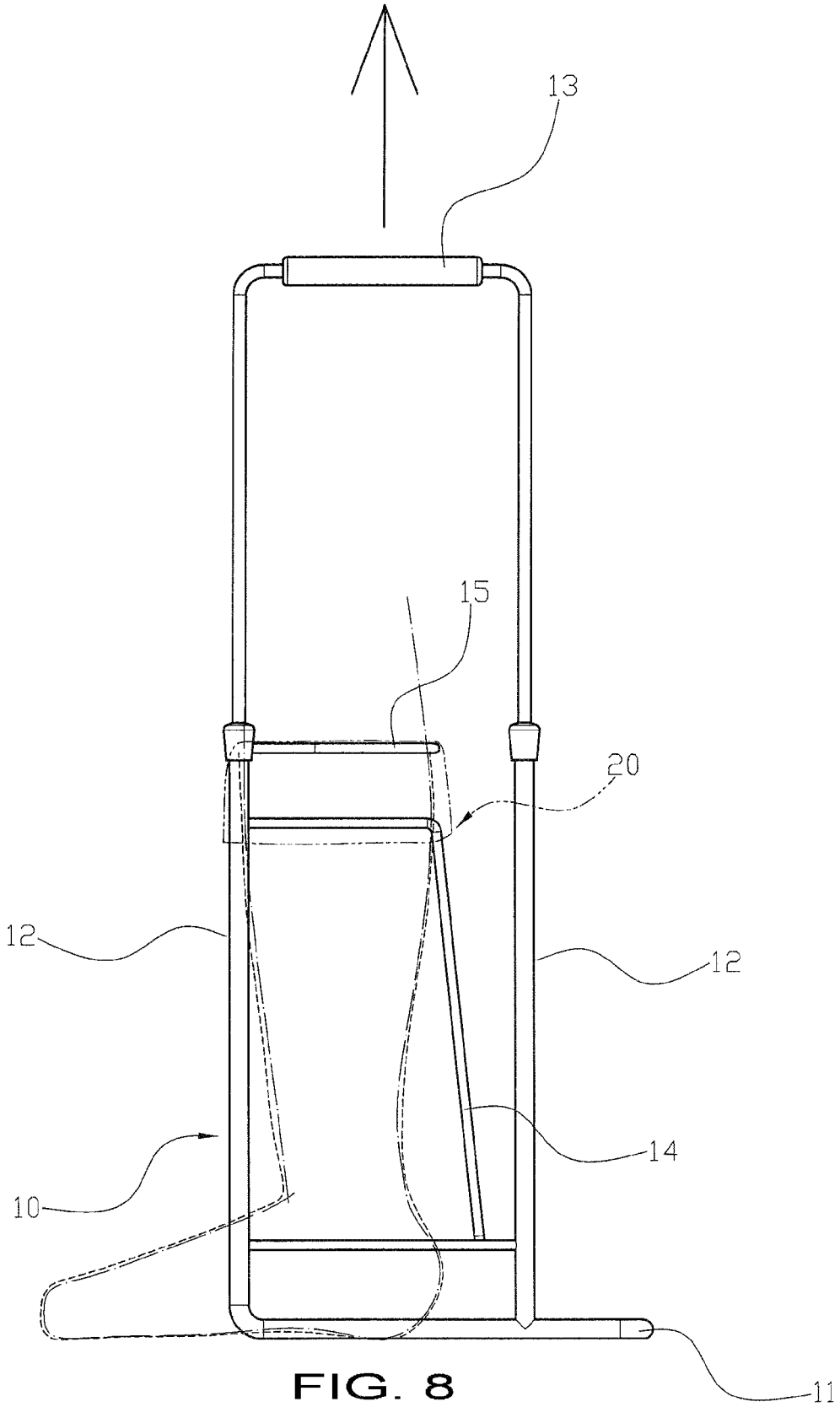
FIG. 8 shows an action diagram 4 in application of the present invention.
Figure 9:
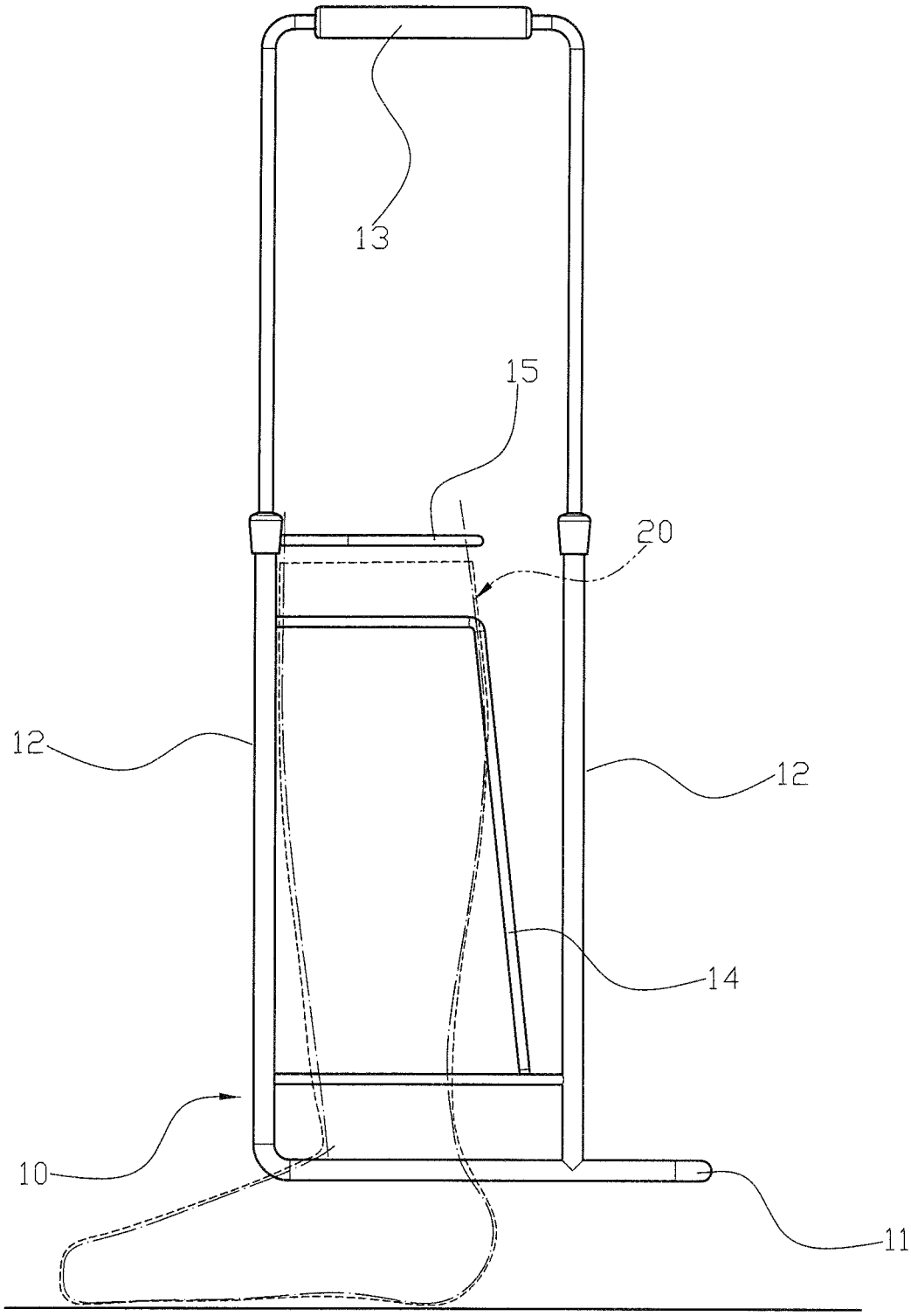
FIG. 9 shows an action diagram 5 in application of the present invention.

First, referring to FIGS. 1 to 3, the present invention provides a sock wearing frame (10) including a frame-wise base (11), wherein each of the two sides of the base (11) is upwardly connected to two upright sticks (12). The two upright sticks (12) are in a sleeve-connection configuration with an external pipe (121) and an internal pipe (122) such that the integral length of the upright sticks (12) can be adjusted through upward and downward translations of the internal pipe (122) in the sock wearing frame (10). In addition, a lift stick (13) is horizontally installed between the two internal pipes (122) at the upper portions of the upright sticks (12). Besides, the internal space surrounded by the upright sticks (12) on the two sides of the sock wearing frame (10) is installed with two supporting frames (14) connected to the upright sticks (12) and upwardly bended. Moreover, a wearing ring (15) is horizontally and backwardly installed over the supporting frames (14), and the front parts of the wearing ring (15) along with the supporting frames (14) on the two sides conjunctively constitute an opening (16).

Next, referring to FIGS. 4 to 9, it can be seen that, in operation, the present invention allows force applications by using the extension of the upright sticks (12) and the lift stick (13) in order to raise the sock wearing frame (10) up, and then pull a sock (20) over in place onto the wearing ring (15) through the sock opening. After this, when the sock wearing frame (10) is placed back on the ground, a user can lift the foot top about to wear a sock, aiming at the sock opening and then extending the foot downwardly so as to wear the sock (20) disposed thereon onto the foot with the treading force and pull up the sock wearing frame (10) to make the sock (20) completely cover the foot thereby preventing folds caused by incomplete sock stretches. It should be noticed that, when the foot steps down through the opening (16) formed by the combination of the supporting frames (14) and the wearing ring (15), the elderly suffering from vertebral wound or stiff joint illness can independently complete such sock wearing actions without other people's help, so that sock wearing actions can no longer bother these patients.

Furthermore, an expansion part (1221) can be configured at the end of the aforementioned internal pipe (122) and, upon inserting the external pipe (121) into the internal pipe (122), a recessed blocking part (1211) can be formed on the upper periphery. Consequently, when the sock wearing frame (10) is pulled up, the blocking part (1211) and the expansion part (1221) can be mutually blocked so the internal pipe (122) will not directly slide out of the external pipe (121). Also, a sheath (123) can be further sleeve installed between the external pipe (121) and the internal pipe (122).

Through the structure of the embodiment described as above, the following benefits can be obtained: with the assistance of the sock wearing frame (10) according to the present invention, the elderly suffering from vertebral wound or stiff joint illness can independently complete sock wearing actions without other people's help, thereby keeping their regular work and rest activities so as to maintain convenience of self-organization in daily lives.

In summary, the technical contents of present invention allow breakthroughs and improvements on structural designs, industrial applicability and advancement thereof can be successfully achieved and the present invention provides many innovative features but remains unpublished, thus indicating that the prerequisites required by Patent Laws or other relevant regulations can be satisfied, thus herein filing the patent application for legal protections.

However, it should be noted that the descriptions set forth as above simply illustrate the preferred embodiments of the present invention, rather than limiting the scope of the present invention thereto. All effectively equivalent changes, alternations or modifications made in accordance with the present invention are deemed to be encompassed within the scope of the present invention delineated by the following claims.

MAJOR COMPONENT SYMBOL DESCRIPTION

10 Sock Wearing Frame
11 Base
12 Upright Stick
121 External Pipe
1211 Blocking Part
122 Internal Pipe
1221 Expansion Part
123 Sheath
13 Lift Stick
14 Supporting Frame
15 Wearing Ring
16 Opening
20 Sock

What is claimed is:

1. A sock wearing frame comprising:
a base;
at least four upright sticks;
at least two lift sticks;
at least two supporting frames; and
at least one wearing ring;
wherein each of the two sides of the base is upwardly connected to two upright sticks;
wherein the upper portions of the two upright sticks are horizontally installed with a lift stick;
wherein the internal space surrounded by the upright sticks on the two sides of the sock wearing frame is installed with two supporting frames connected to the upright sticks and upwardly bended;
wherein a wearing ring is horizontally and backwardly installed over the supporting frame;
wherein the front part of the wearing ring along with the supporting frames on the two sides conjunctively constitute an opening;
wherein the upright sticks are configured in a mutually sleeve connected form with an external pipe and an internal pipe, thereby modifying the integral length of the upright sticks through upward and downward translations of the internal pipe in the sock wearing frame, and wherein a lift stick is horizontally installed between the two internal pipes at the upper portions of the upright sticks; and
wherein an expansion part is configured at the end of the internal pipe and, wherein upon inserting the external pipe into the internal pipe, a recessed blocking part is formed on the upper periphery.

2. A sock wearing frame comprising:
a base;
at least four upright sticks;
at least two lift sticks;
at least two supporting frames; and
at least one wearing ring;
wherein each of the two sides of the base is upwardly connected to two upright sticks;
wherein the upper portions of the two upright sticks are horizontally installed with a lift stick;
wherein the internal space surrounded by the upright sticks on the two sides of the sock wearing frame is installed with two supporting frames connected to the upright sticks and upwardly bended;
wherein a wearing ring is horizontally and backwardly installed over the supporting frame;
wherein the front part of the wearing ring along with the supporting frames on the two sides conjunctively constitute an opening;
wherein the upright sticks are configured in a mutually sleeve connected form with an external pipe and an internal pipe, thereby modifying the integral length of the upright sticks through upward and downward translations of the internal pipe in the sock wearing frame, and wherein a lift stick is horizontally installed between the two internal pipes at the upper portions of the upright sticks; and
wherein a sheath is installed between the external pipe and the internal pipe.

* * * * *